US006693595B2

(12) United States Patent
Lee

(10) Patent No.: US 6,693,595 B2
(45) Date of Patent: Feb. 17, 2004

(54) CYLINDRICAL DOUBLE-LAYER MICROSTRIP ARRAY ANTENNA

(75) Inventor: Choon Sae Lee, Dallas, TX (US)

(73) Assignee: Southern Methodist University, Dallas, TX (US)

( * ) Notice: Subject to any disclaimer, the term of this patent is extended or adjusted under 35 U.S.C. 154(b) by 0 days.

(21) Appl. No.: 10/131,990

(22) Filed: Apr. 25, 2002

(65) Prior Publication Data

US 2003/0201937 A1 Oct. 30, 2003

(51) Int. Cl.[7] ..... H01Q 21/20

(52) U.S. Cl. ..... 343/700 MS; 343/844

(58) Field of Search ..... 343/700 MS, 769, 343/846, 824, 833, 837, 803, 853

(56) References Cited

U.S. PATENT DOCUMENTS

| | | | | | |
|---|---|---|---|---|---|
| 4,605,932 | A | * | 8/1986 | Butscher et al. | 343/700 MS |
| 4,899,162 | A | * | 2/1990 | Bayetto et al. | 343/700 MS |
| 4,980,692 | A | * | 12/1990 | Rudish et al. | 343/700 MS |
| 6,091,365 | A | * | 7/2000 | Derneryd et al. | 343/700 MS |
| 6,133,878 | A | * | 10/2000 | Lee | 343/700 MS |
| 6,133,882 | A | * | 10/2000 | LaFleur et al. | 343/700 MS |
| 6,281,847 | B1 | * | 8/2001 | Lee | 343/700 MS |
| 6,285,322 | B1 | * | 9/2001 | Johannisson et al. | 343/700 MS |

OTHER PUBLICATIONS

Hsieh, Tung–hung, "Double–Layer Microstrip Array Antenna," a dissertation presented to the graduate faculty of School of Applied Science and Engineering, Southern Methodist University, Dec. 1996, Dallas, Texas U.S.A.

Lee et al., "Strip–Line–Fed Double–Layer Microstrip Antenna," *Microwave and Optical Technology Letters*, Apr. 1997, pp. 295–296, vol. 14, No. 5, John Wiley & Sons, Inc., U.S.A.

Lee et al., "Linear Microstrip Array Antenna With a Single Feed Network," *Microwave and Optical Technology Letters*, Oct. 1999, pp. 25–27, vol. 23, No. 1, John Wiley & Sons, Inc., U.S.A.

Hsieh et al, "Double–Layer High–Gain Microstrip Array Antenna," *IEEE Transactions on Antennas and Propagation*, Jul. 2000, pp. 1033–1035, vol. 48, No. 7.

* cited by examiner

*Primary Examiner*—James Clinger
(74) *Attorney, Agent, or Firm*—Carr LLP

(57) ABSTRACT

A microstrip antenna has first and second cylindrically-shaped dielectric layers having first sides secured together with an array of conducting strips conformally interposed therebetween, the strips being spaced to define a slot between each pair of adjacent strips. A conductive ground plane is disposed on an interior second side of the first dielectric layer, and an array of spaced apart radiating patches are conformally disposed on an exterior second side of the second dielectric layer, each of which patches is positioned over a corresponding slot. Responsive to electromagnetic energy, a high-order standing wave is induced in the antenna and a directed beam is transmitted from and/or received into the antenna.

29 Claims, 6 Drawing Sheets

CYLINDRICAL DOUBLE-LAYER MICROSTRIP ARRAY ANTENNA

BACKGROUND

The number of cellular phone services has substantially increased world-wide and, as it has, the world-wide demand for antennas having the capacity for receiving such wireless services has also increased. This increased demand has typically been met by reflector, or "dish," antennas, which are well known in the art. Reflector antennas are commonly used in cellular environments for receiving telephone services, such as the transmission and reception of cellular phone signals from a moving vehicle. However, reflector antennas have several drawbacks. For example, they are bulky and relatively expensive for residential use. Furthermore, inherent in reflector antennas are feed spillover and aperture blockage by a feed assembly, which significantly reduces the aperture efficiency of a reflector antenna, typically resulting in an aperture efficiency of only about 55%.

An alternative antenna, such as a microstrip antenna, overcomes many of the disadvantages associated with reflector antennas. Microstrip antennas, for example, require less space, are simpler and less expensive to manufacture, and are more compatible with printed-circuit technology than reflector antennas. Microstrip array antennas, i.e., microstrip antennas having an array of microstrips, may be used with applications requiring high directivity. Microstrip array antennas, however, typically rely on traveling waves and require a complex microstrip feed network, which contributes significant power loss to the overall antenna loss.

What is needed, then, is a low-cost, compact antenna having a high aperture efficiency, and which does not require a complex feed network.

SUMMARY OF THE INVENTION

The present invention, accordingly, provides for a low-cost, compact antenna having a high aperture efficiency. To this end, a cylindrical, double-layer microstrip antenna of the present invention includes first and second cylindrically-shaped dielectric layers having first sides secured together with an array of conducting strips conformally interposed therebetween, the strips being spaced to define a slot between each pair of adjacent strips. A conductive ground plane is disposed on an interior second side of the first dielectric layer, and an array of spaced apart radiating patches are conformally disposed on an exterior second side of the second dielectric layer, each of which patches is positioned over a corresponding slot. Responsive to electromagnetic energy, a high-order standing wave is induced in the antenna and a directed beam is transmitted from and/or received into the antenna.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
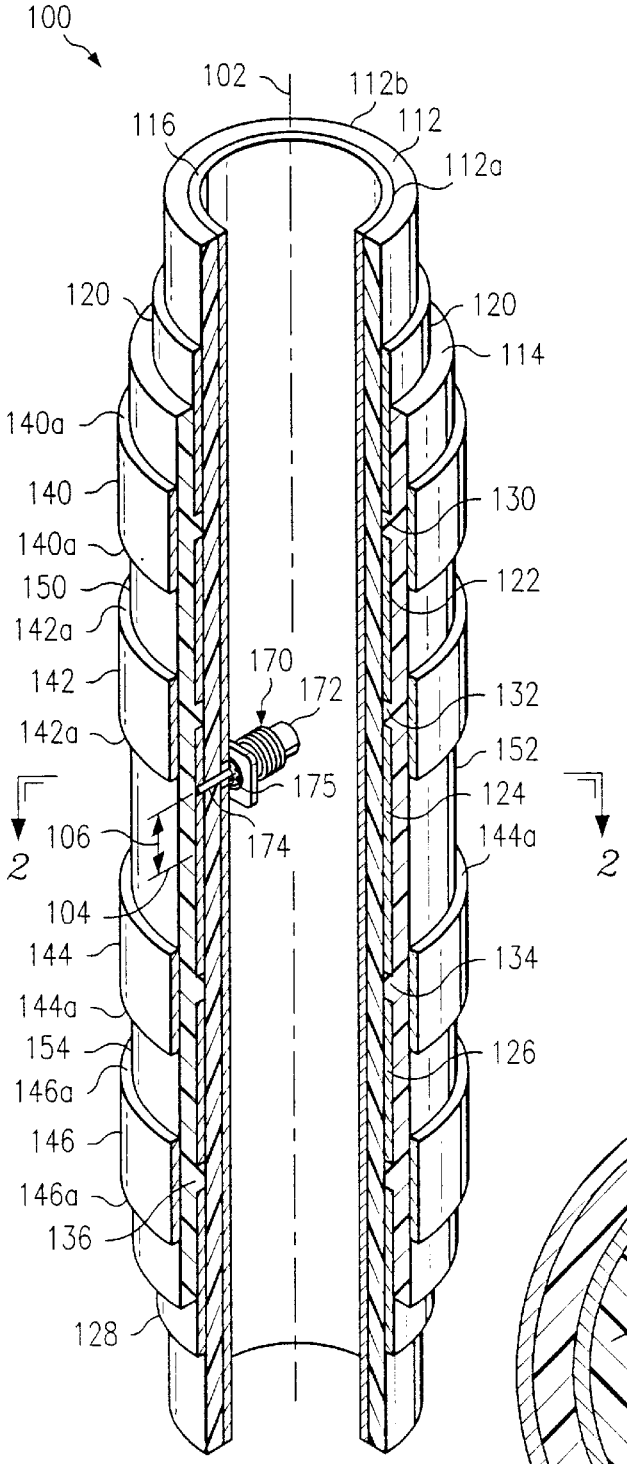
FIG. 1 is a partially cut-away perspective view of a cylindrical array antenna utilizing a single feed line.

In the following discussion of the FIGURES, certain depicted elements are, for the sake of clarity, not necessarily shown to scale, and like or similar elements are designated by the same reference numeral through the several views.

It is noted that, as used herein (unless indicated otherwise), the term "cylindrical" includes shapes having circular as well as non-circular cross-sections. Thus, a cylindrical shape may include triangular cross-sections and generally polygonal cross-sections.

It is further noted that, unless specified otherwise, $\lambda_O$ is understood to be the wavelength of a beam of EM energy in free space (i.e., $\lambda_O$=c/f, where c is the speed of light in free space, and f is the frequency of the beam), and that $\lambda_\epsilon$ is understood to be the wavelength of a beam of EM energy in a dielectric medium (i.e., $\lambda_\epsilon$=v/f, where v is the speed of light in the dielectric medium). It is further understood that, as used herein, elements referred to as "strips," "patches," "striplines," "stubs," and "transmission lines" constitute conductive microstrips, which preferably have a thickness of approximately 1 mil (0.001 inch). Ground planes and edge conductors, preferably, also have a thickness of approximately 1 mil, but may be thicker (e.g., 0.125 inches), if desired, for providing structural support to a respective antenna. It is understood that thickness is generally measured in a direction perpendicular to the surface of dielectric to which the microstrips, and ground planes are respectively bonded.

It is still further noted that, unless specified otherwise, dielectric material used in accordance with the present invention (in other than cables) is preferably fabricated from a mechanically stable material having a relatively low dielectric constant. Where multiple layers of dielectric material are used, each layer may comprise similar or dissimilar material and, depending on the application of the antenna, performance may be enhanced by using different materials in each layer, each having different dielectric constants. Each dielectric layer may be suitably multilayered to provide a desired dielectric constant. Each layer of a dielectric, preferably, has a thickness of between 0.003 $\lambda_O$ and 0.050 $\lambda_O$ and to have a greater thickness for greater bandwidths.

It is still further noted that reference to a high-order standing wave, as used herein, comprises one of the high-order standing waves defining modes other than a fundamental mode.

It is still further noted that, as used herein (unless indicated otherwise), ground planes, edge conductors, microstrips (e.g., strips and patches), and the like, preferably comprise conductive materials such as copper, aluminum, silver, and/or gold. Reference made herein to the bonding of such conductive materials to a dielectric material may, preferably, be achieved using conventional printed-circuit, metallizing, decal transfer, monolithic microwave integrated circuit (MMIC) techniques, chemical etching techniques, or any other suitable technique. For example, in accordance with a chemical etching technique, a dielectric layer may be clad to one of the aforementioned conductive materials. The conductive material may then be selectively etched away from the dielectric layer, using conventional chemical etching techniques, to thereby define any of the microstrip patterns described herein. Where applicable, a second dielectric layer may be bonded to the surface of the aforementioned dielectric having the conductive material, using any suitable technique, such as by creating a bond with very thin (e.g., 1.5 mil) thermal bonding film.

It is still further noted that reference is made in the following description of the present invention to the use of calculations and analyses, such as the cavity model, discussed, for example, by C. S. Lee and T. H. Hsieh in an article entitled "Linear microstrip array antenna with a single feed network," published in *Microwave and Optical Technology Letters*, Vol. 23, pp. 25–27, October 1999, and in an article entitled "Double-layer, high-gain microstrip antenna," published in the *IEEE Transactions on Antennas and Propagation*, Vol. 48, pp. 1033–1035, July 2000, and by T. H. Hsieh in an article entitled "Double-layer Microstrip Array Antenna," published as a Ph.D. dissertation in the Electrical Engineering Department at Southern Methodist University in 1996. These articles are hereby incorporated in their entirety by reference, and will together be referred to hereinafter as "Lee and Hsieh."

Figure 2:
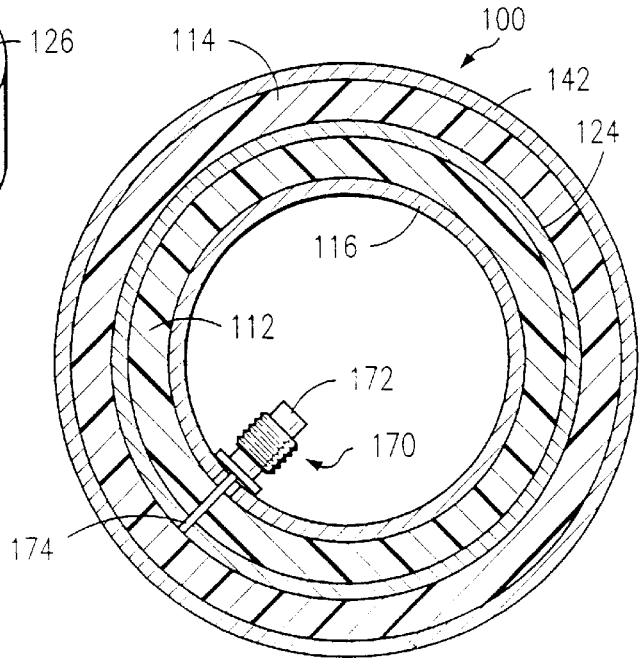
FIG. 2 is a plan cross-sectional view of the antenna of FIG. 1 taken along the line 2—2 of FIG. 1.

Referring to FIGS. 1 and 2, the reference numeral 100 designates, in general, a cylindrical microstrip array antenna embodying features of the present invention for transmitting and receiving beams of electromagnetic (EM) energy. As viewed in FIG. 1, the antenna 100 defines a longitudinal axis 102 and includes cylindrically-shaped, first and second dielectric layers 112 and 114, respectively. The inside diameter of the layer 112 is generally small (relative to the wavelength) for producing an omnidirectional radiating pattern in azimuthal directions (i.e., radiated power is constant around the axis of symmetry while maintaining the same angle from the axis).

The first dielectric layer 112 defines an interior side 112*a* to which a conductive ground plane 116 is bonded, and an exterior side 112*b* to which an array of five spaced concentric conductive cylindrical strips 120, 122, 124, 126, and 128 are bonded for forming a cylindrical transmission-line cavity within the dielectric layer 112. The longitudinal width of the cylindrical strips 120, 122, 126, and 128 is preferably between 0.50 $\lambda_\epsilon$ and 0.75 $\lambda_\epsilon$, and the longitudinal width of the center cylindrical strip 124 is preferably about 20–50% wider than the strips 120, 122, 126, and 128. The strips 120, 122, 124, 126, and 128 are spaced to form between adjacent strips thereof cylindrical coupling slots 130, 132, 134, and 136, each of which slots has a longitudinal width that is preferably between 0.01 $\lambda_\epsilon$ and 0.20 $\lambda_\epsilon$.

The second dielectric layer 114 is bonded to the exterior surface 112*b* of the first dielectric layer 112 and to the strips 120, 122, 124, 126, and 128. The second dielectric layer 114 defines an outer surface 114*a* to which an array of four cylindrical radiating patches 140, 142, 144, and 146 are bonded. Each of the patches 140, 142, 144, and 146 have longitudinal widths preferably between 0.25 $\lambda_\epsilon$ and 0.50 $\lambda_\epsilon$, are positioned over the annular slots 130, 132, 134, and 136, respectively, and are spaced so that cylindrical apertures 150, 152, and 154 are formed between adjacent patches. The patches 140, 142, 144, and 146, furthermore, define open (i.e., radiating) horizontal (as viewed in FIG. 1) edges 140*a*, 142*a*, 144*a*, and 146*a*, respectively.

For optimal performance at a particular frequency, the widths (i.e., the longitudinal dimensions) of the strips 120, 122, 124, 126, and 128, the slots 130, 132, 134, and 136, the patches 140, 142, 144, and 146, and the apertures 150, 152, and 154, are individually calculated so that a relatively high-order standing wave is formed in the antenna cavity, defined within the dielectric layers 112 and 114, and so that fields radiated from the radiating edges 140*a*, 142*a*, and 144*a* interfere constructively with one another. Additionally, the sizes and locations of the slots 130, 132, 134, and 136 and of the apertures 150, 152, and 154, are calculated for controlling not only the resonant frequency, but also the input impedance, of the antenna 100. It can be appreciated then that the field distribution within the antenna cavity affects the desired radiation and the input impedance of the antenna 100. The number of patches, such as the patches 140, 142, 144, and 146, determines not only the overall size, but also the directivity, of the antenna 100, wherein greater directivity is obtained by a greater number of patches. The sidelobe levels of the antenna 100 are determined by the field distribution at the radiating edges 140*a*, 142*a*, 144*a*, and 146*a*. Therefore, antenna characteristics, such as directivity, sidelobe levels, and input impedance are controlled by the width and the position of each of the strips 120, 122, 124, 126, and 128, and of each of the patches 140, 142, 144, and 146. To achieve high directivity, the field distribution at the radiating edges 140*a*, 142*a*, 144*a*, and 146*a* is assumed to be as uniform as possible. There are electric field null points in the dielectric layer 112 between adjacent slots 130, 132, and 134. In some instances, one or more shortening pins (not shown) may be disposed in the antenna 100 electrically connecting the ground plane 116 to one or more strips 120, 122, 124, 126, and/or 128 to suppress unwanted mode excitations. The foregoing calculations and analysis utilize techniques, such as the cavity model, discussed, for example, by Lee and Hsieh, and will, therefore, not be discussed in further detail herein.

A conventional SMA probe 170 is provided for feeding a linear polarized (LP) signal from a cable (not shown) to a feed point in the antenna 100 located to optimize the impedance matching of the antenna 100. The SMA probe 170 includes, for delivering EM energy to and/or from the antenna 100, an outer conductor 172 which is electrically connected to the ground plane 116, an inner (or feed) conductor 174 which is electrically connected to the annular strip 124, and an annular dielectric 175 interposed between the inner and outer conductors 172 and 174, respectively. The inner conductor 174 is preferably connected to the annular strip 124 off of the longitudinal center 104 of the strip 124 by a longitudinal distance 106 of between 0.125 $\lambda_\epsilon$ and 0.250 $\lambda_\epsilon$. While the SMA probe 170 is preferred, any suitable coaxial probe and/or connection arrangement may be used to implement the foregoing connections. For example, a conductive adhesive (not shown) may be used to bond and maintain contact between the inner conductor 174 and the annular strip 124, and an appropriate seal (not shown) may be provided where the SMA probe 170 passes through the ground plane 116 to hermetically seal the connection. Though not shown, it is understood that the other end of the SMA probe 170, not connected to the antenna 100, is connectable via a cable (not shown) to a signal generator or to a receiver such as a cellular signal decoder used with telephone signals.

In operation, the antenna 100 may be used for receiving and/or transmitting beams of EM energy having a cylindrically symmetrical radiation pattern that is polarized in the same direction as the longitudinal axis 102 of the antenna 100. To exemplify how the antenna 100 may be used, the antenna 100, oriented as shown in FIG. 1, may be positioned in a single-sector telecommunications cell site for use as a base station antenna for transmitting to and receiving from mobile cellular phones (not shown) a beam carrying a communication signal within a predetermined frequency band or channel.

Assuming that the elements of the antenna 100 are correctly sized for transmitting and receiving such communication signals, then signals will pass through the apertures 150, 152, and 154, and induce a standing wave which will resonate between the two dielectric layers 112 and 114. To exemplify with respect to the transmission of communication signals, when a transmitter (not shown), such as an encoder, generates signals to the SMA probe 170, a standing wave is induced in the transmission-line cavity defined by the dielectric layer 112 and the signal is transmitted from the antenna 100 through the apertures 150, 152, and 154 in a cylindrically symmetrical radiation pattern with vertical polarization to mobile (i.e., cellular) phones within the cell (not shown). It is well-known that antennas transmit and receive signals reciprocally. Accordingly, it can be appreciated that the operation of the antenna 100 for receiving signals is reciprocally identical to that of the antenna for receiving signals. To that end, with respect to the reception of communication signals, signals generated by a cell phone (not shown) to the antenna 100 pass through the apertures 150, 152, and 154, a standing wave is induced in the transmission-line cavity defined by the dielectric layer 112, and the signal is communicated through the SMA probe 170 to a receiver, such as a decoder (not shown).

Figure 3:
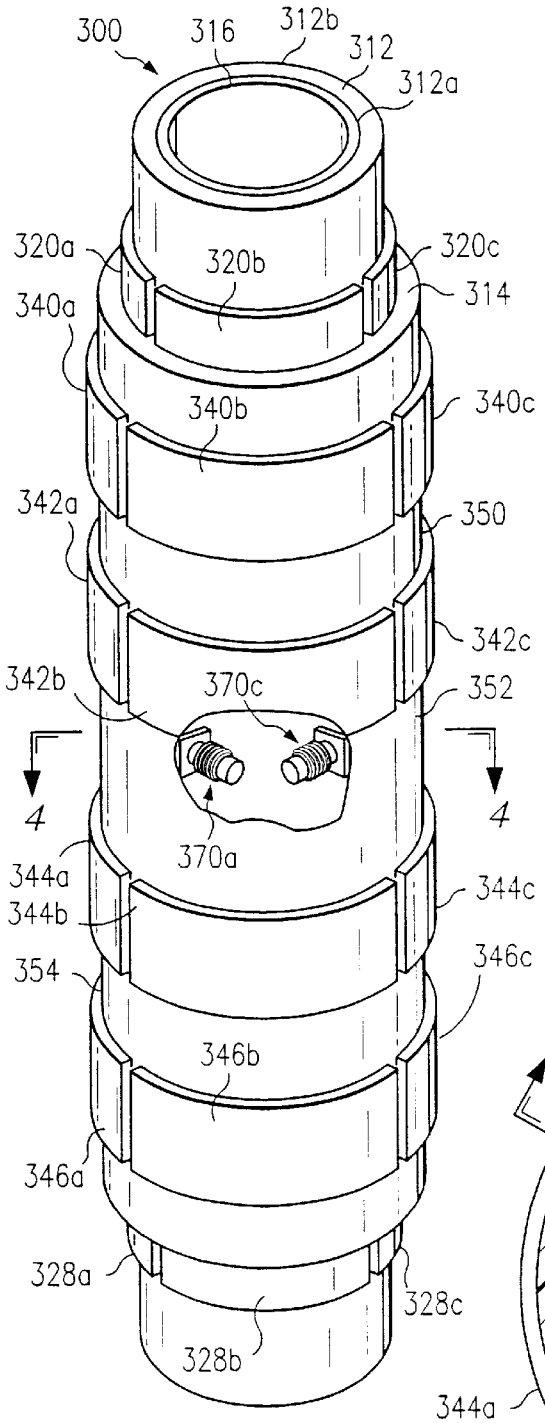
FIG. 3 is a perspective view of an alternate embodiment of the cylindrical array antenna of FIG. 1 utilizing three feed lines.
Figure 4:
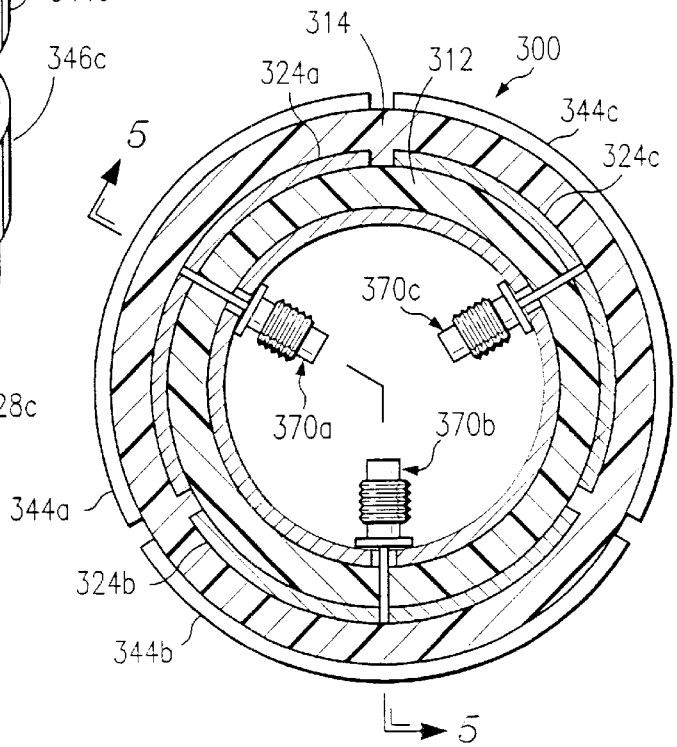
FIG. 4 is a plan cross-sectional view of the antenna of FIG. 3 taken along the line 4—4 of FIG. 3.
Figure 5:
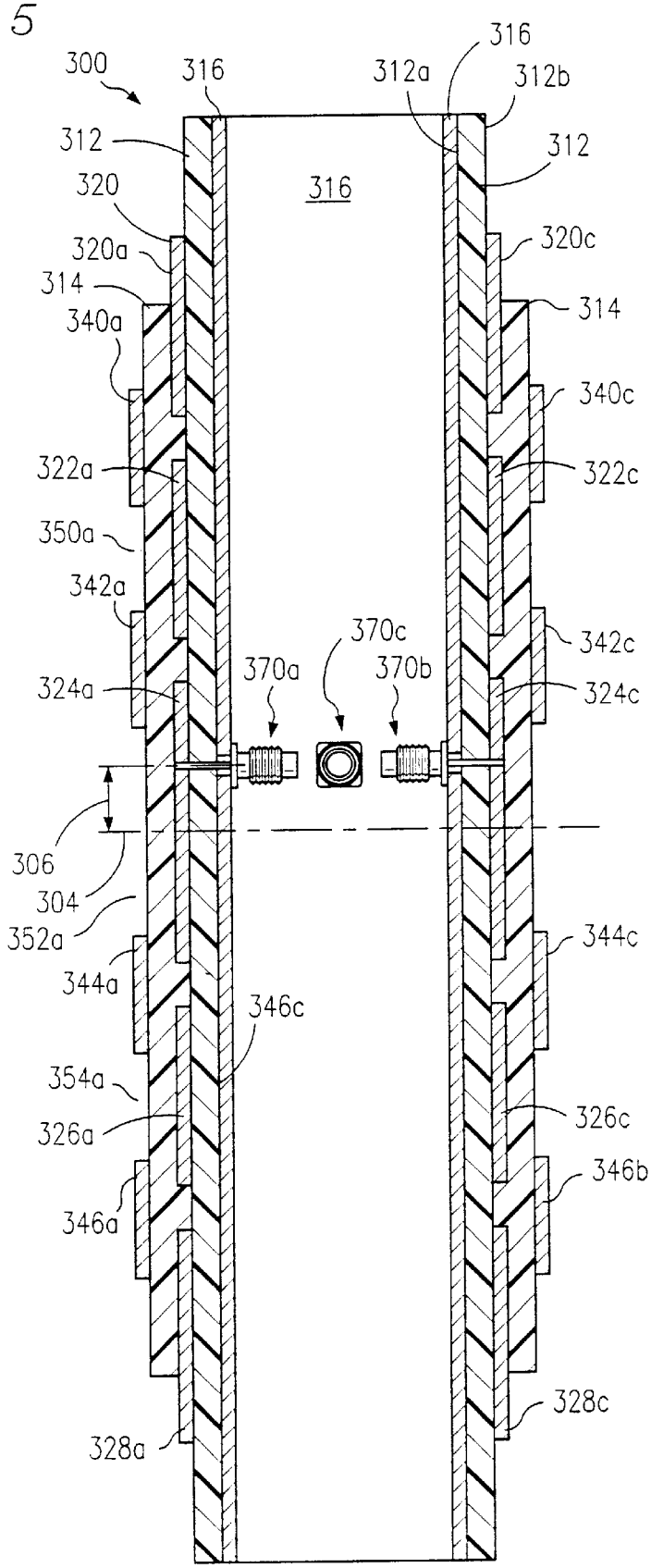
FIG. 5 is an elevational cross-sectional view of the antenna of FIG. 3 taken along the line 5—5 of FIG. 3.

FIGS. 3–5 depict an embodiment of the present invention in an antenna 300, which is similar to the embodiment of the antenna 100 of FIG. 1, except that the strips 120, 122, 124, 126, and 128 and the patches 140, 142, 144, and 146 are divided for directing sectored EM beams into three sectors, of substantially 120° each, such as are used in wireless telecommunication cells. Accordingly, as shown in FIG. 3, the strip 120 (FIG. 1) is divided into three sectors, namely, strip sectors 320*a*, 320*b*, and 320*c* and, as shown in FIG. 4, the strip 124 (FIG. 1) is divided into three sectors, namely, strip sectors 324*a*, 324*b*, and 324*c*. FIG. 5 depicts two of the three substantially 120° sectors into which strips 120, 122, 124, 126, and 128 of FIG. 1 are divided, namely, sectors 320*a* and 320*c* from strip 120, sectors 322*a* and 322*c* from strip 122, sectors 324*a* and 324*c* from strip 124, sectors 326*a* and 326*c* from strip 126, sectors 328*a* and 328*c* from strip 128. As further shown in FIG. 3, the patch 140 of FIG. 1 is divided into three, substantially 120°, sectors, namely, patch sectors 340*a*, 340*b*, and 340*c*. The patches 142, 144, 146 (FIG. 1), are also similarly sectored into three sectors each as the patch 140 is sectored, as partially depicted in FIG. 3, namely, three sectors 342*a*, 342*b*, and 342*c* of the patch 142, three sectors 344*a*, 344*b*, and 344*c* of the patch 144, and three sectors 346*a*, 346*b*, and 346*c* of the patch 146.

As most clearly shown in FIG. 4, three conventional SMA probes 370*a*, 370*b*, and 370*c*, similar to the SMA probe 170 discussed above with respect to FIG. 1, are provided for feeding linear polarized (LP) signals from cables (not shown) to feed points in the antenna 300. The probes 370*a*, 370*b*, and 370*c* are preferably connected to respective annular strip sectors (not shown), which correspond to the strip 124 (FIG. 1) and, as shown most clearly in FIG. 5, are positioned off of the longitudinal center 304 of the respective strip sector by a longitudinal distance 306 of between 0.125 $\lambda_\epsilon$ and 0.250 $\lambda_\epsilon$. While the probes 370*a*, 370*b*, and 370*c* are preferably SMA probes, any suitable coaxial probes and/or connection arrangement may be used to implement the foregoing connections. For example, a conductive adhesive (not shown) may be used to bond and maintain contact between the inner conductor of each probe and the respective strip sector, and an appropriate seal (not shown) may be provided where the probes pass through the ground plane 316 to hermetically seal the connection. Though not shown, it is understood that the other end of the probes 370*a*, 370*b*, and 370*c*, not connected to the antenna 300, are connectable via a cable (not shown) to a signal generator or to a receiver.

Other than the aspects of the antenna 300 discussed above with respect to FIGS. 3–5, the antenna 300 is virtually identical to the antenna 100 discussed above with respect to FIGS. 1–2.

In operation, the antenna 300 may be used for receiving and/or transmitting sector beams of EM energy that is polarized in the same direction as the longitudinal axis of the antenna 300. To exemplify how the antenna 300 may be used, the antenna 300, oriented as shown in FIG. 3, may be positioned in a telecommunications cell (not shown) for use as a base station antenna for transmitting to and receiving from mobile cellular phones (not shown) within a sector of the cell a beam carrying a communication signal within a predetermined frequency band or channel. For purposes of illustration, it is assumed herein that the mobile cellular phones are located in a sector served by elements designated by elements having an "a" appended to them, though all sectors would behave similarly with respect to their sectors. It is assumed that that the elements of the antenna 300 are correctly sized for transmitting and receiving communication signals.

To exemplify with respect to the transmission of communication signals, when a transmitter (not shown), such as an encoder, generates signals to an SMA probe 370*a*, a standing wave is induced in the transmission-line cavity defined by the two dielectric layers 312 and 314, and the signal is transmitted from the antenna 300 through the apertures 350*a*, 352*a*, and 354*a* in a sectoral radiation pattern with vertical polarization to mobile phones located within the sector of the cell.

It is well-known that antennas transmit and receive signals reciprocally. Accordingly, it can be appreciated that the operation of the antenna 300 for receiving signals is reciprocally identical to that of the antenna for receiving signals. To that end, with respect to the reception of communication signals, signals generated by a cell phone to the antenna 300 pass through the apertures 350*a*, 352*a*, and 354*a*, a standing wave is induced in the transmission-line cavity defined by the dielectric layer 312, and the signal is communicated through the SMA probe 370*a* to a receiver, such as a decoder (not shown).

It can be appreciated that the number of sectors that the antenna 300 may support corresponds to the number of sectors that the strips and patches are divided into. Accordingly, the antenna 300 may comprise more or less sectors than the three sectors discussed above.

Figure 7:
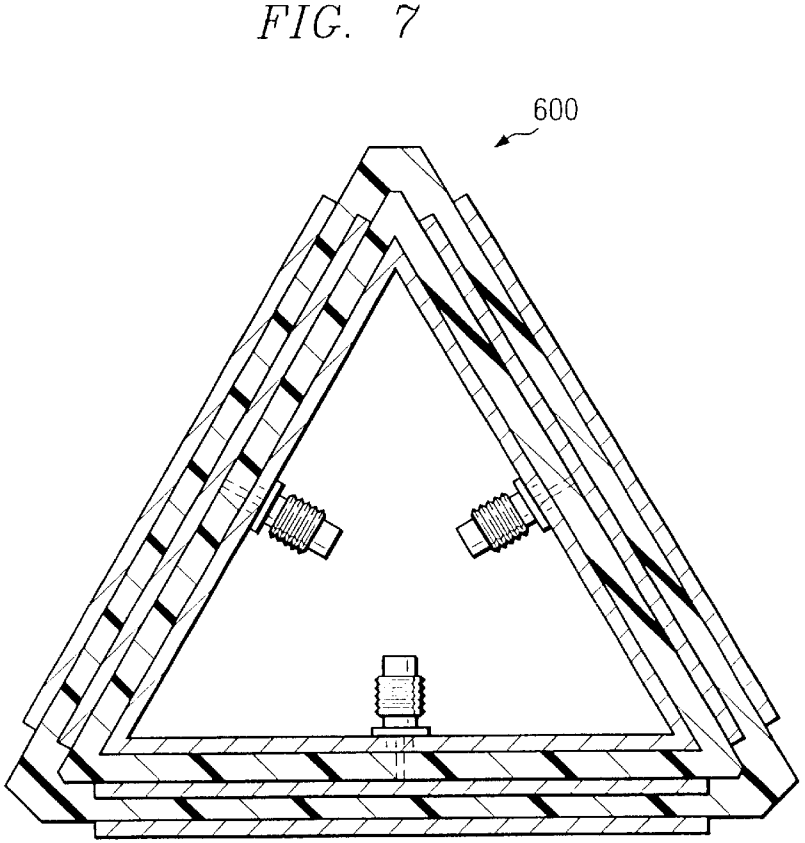
FIG. 7 is a plan cross-sectional view of the antenna of FIG. 6 taken along the line 7—7 of FIG. 6.
Figure 6:
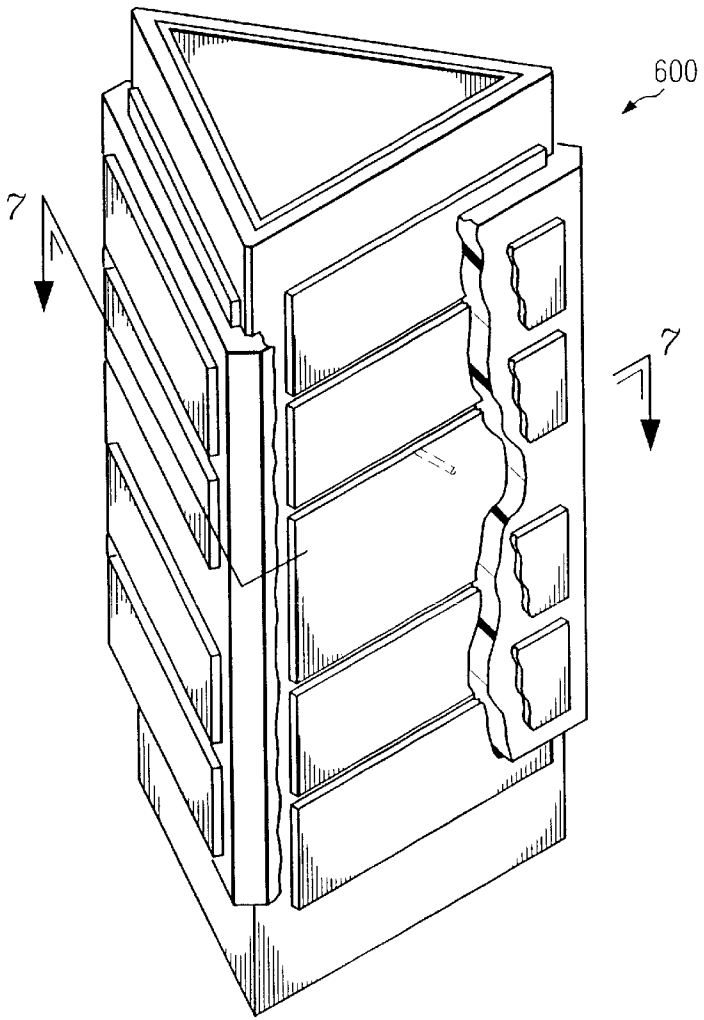
FIG. 6 is a partially cut-away perspective view of a triangular array antenna.

FIGS. 6–7 show an array antenna 600 having a triangular cross-section configured for transmitting and receiving sectored EM beams in three substantially 120° sectors of a cell. The structure of the antenna 600 is similar to that of the antenna 300 discussed above with respect to FIGS. 3–5, but for having a triangular cross-section rather than a circular cross-section. The triangular cross-section of the antenna 600 is sized according to the directivity desired for the antenna, wherein higher directivity is obtained using a larger cross-sectional area.

It will be appreciated that the antenna 600 may be configured with more or less than three sides (as viewed in FIG. 7), wherein each side is provided with flat strips and patches, which, other than being flat, are substantially similar to corresponding curved strips and patches shown for one side of the antenna 600 in FIG. 6. The strips and patches on each side may, furthermore, be connected to an SMA probe for transmitting EM beams transmitted from the SMA probe, and/or for receiving signals to be received by the SMA probe. The antenna 600 may thus be configured to have any number of sides, each of which sides corresponds to one sector. For example, the antenna 600 may be configured with a hexagon (i.e., six-sided) cross-section (instead of a triangular cross-section) with strips and patches on each side connected to a respective SMA probe for transmitting and receiving sectored EM beams in any one or more of six 60° sectors.

It is considered that, upon a reading of the present description, a person having ordinary skill in the art could readily modify the antenna 300 or 600 to have a number of sides corresponding to a desired number of sectors of a cell to be served. The structure and operation of the antenna 600 is similar to that of the antenna 300 discussed above and, therefore, will not be discussed in further detail herein.

Figure 8:
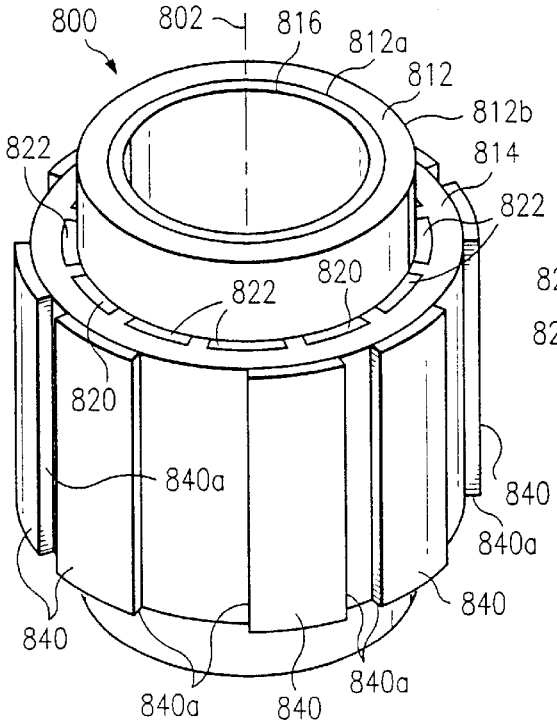
FIG. 8 is a perspective view of a cylindrical array antenna.
Figure 9:
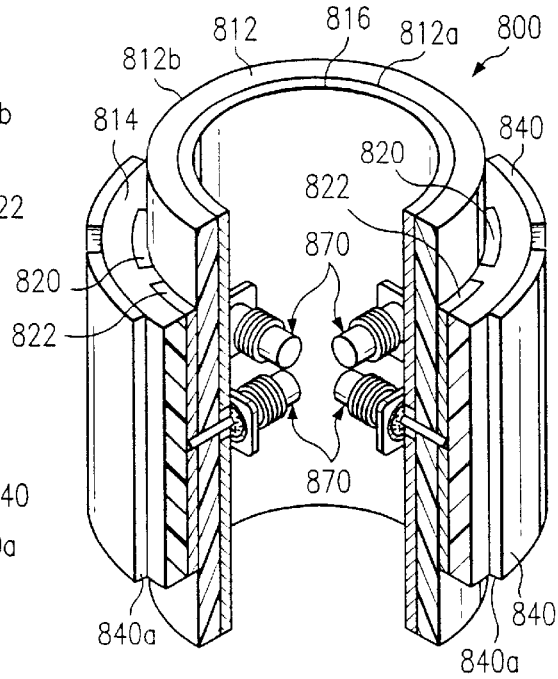
FIG. 9 is a partially cut-away perspective view of the antenna of FIG. 8 showing four feed lines.
Figure 10:
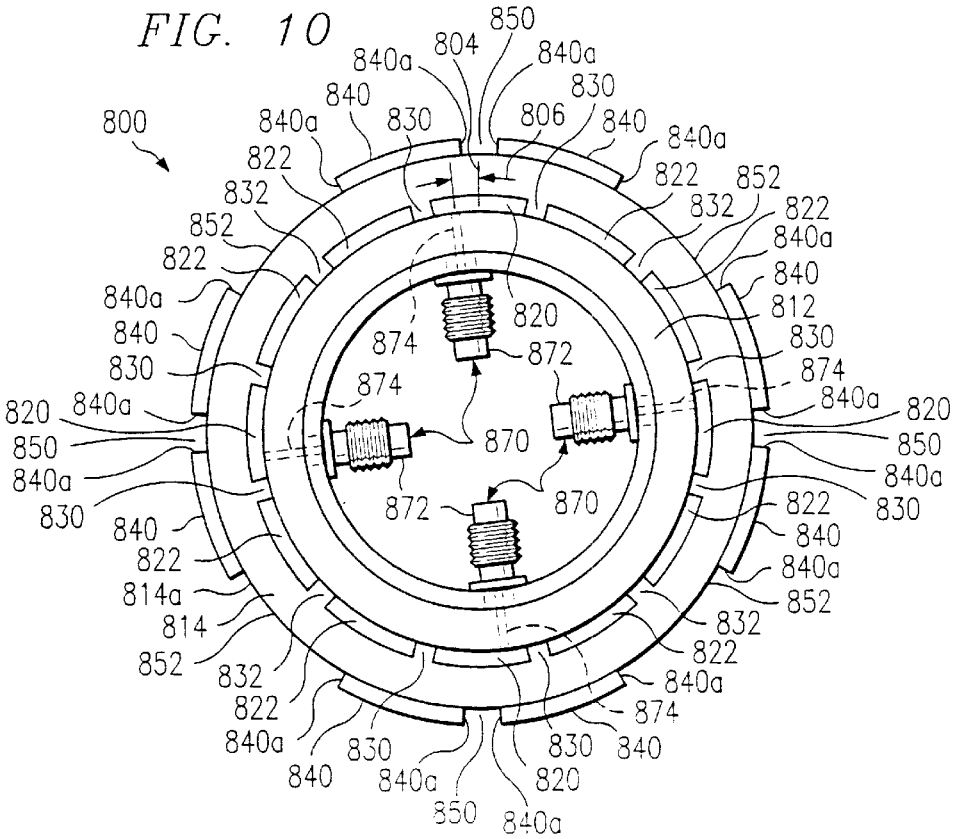
FIG. 10 is a plan view of the antenna of FIG. 8.

FIGS. 8–10 depict a cylindrical array antenna 800 configured for generating EM radiation polarized in the azimuthal direction for transmitting and receiving sectored EM beams in four substantially 90° sectors of a cell. The antenna 800 defines a longitudinal axis 802 and includes cylindrically-shaped, first and second dielectric layers 812 and 814, respectively. The inside diameter of the antenna 800 is sized according to the directivity desired for the antenna, wherein higher directivity and greater separation from adjacent beams is obtained using a larger cross-sectional area.

The first dielectric layer 812 defines an interior side 812*a* to which a conductive ground plane 816 is bonded, and an exterior side 812*b* to which an array of twelve spaced arcuate conductive strips 820 and 822 are bonded for forming a cylindrical transmission-line cavity within the dielectric layer 812. Each arcuate strip 820 and 822 has a length (i.e., in the direction of the longitudinal axis 802) preferably less than 2 $\lambda_\epsilon$, but which may vary depending on the directivity desired in the axial direction, wherein a greater length provides greater directivity. The strips 820 and 822 are spaced to form between adjacent strips thereof arcuate coupling slots 830 and 832, each of which slots has a circumferential width that is preferably between 0.01 $\lambda_\epsilon$ and 0.20 $\lambda_\epsilon$.

The second dielectric layer 814 is bonded to the exterior surface 812*b* of the first dielectric layer 812 and to the strips 820 and 822. The second dielectric layer 814 defines an outer surface 814*a* to which an array of eight arcuate radiating patches 840 are bonded thereto. Each of the patches 840 has a longitudinal length preferably less than 2 $\lambda_\epsilon$, but which may vary depending on the directivity desired in the axial direction, wherein a greater length provides greater directivity. Each patch is also centrally positioned over the arcuate slots 830, and is spaced so that arcuate apertures 850 and 852 are alternatingly formed between adjacent patches 840. The patches 840, furthermore, define open (i.e., radiating) edges 840*a*.

For optimal performance at a particular frequency, the widths (i.e., the circumferential dimensions) of the strips 820 and 822, the slots 830 and 832, the patches 840, and the apertures 850 and 852, are individually calculated so that a relatively high-order standing wave is formed in the antenna cavity, defined within the dielectric layers 812 and 814 and so that fields radiated from the radiating edges 840*a* interfere constructively with one another. Additionally, the size and location of the slots 830 and 832, and of the apertures 850 and 852, are calculated for controlling not only the resonant frequency, but also the input impedance, of the antenna 800.

It can be appreciated that the field distribution within the antenna cavity affects the desired radiation and the input impedance of the antenna 800. The number of patches, such as the patches 840, determines not only the overall size, but also the directivity in the azimuthal direction, of the antenna 800, wherein greater directivity is obtained by a greater number of patches. The sidelobe levels in the azimuthal direction of the antenna 800 are determined by the field distribution at the radiating edges 840*a*. Therefore, antenna characteristics, such as directivity, sidelobe levels, and input impedance are controlled by the width and the position of each of the strips 820 and 822, and of each of the patches 840. To achieve high directivity, the field distribution at the radiating edges 840*a* is assumed to be as uniform as possible. There are electric field null points in the dielectric layer 812 between adjacent slots 830 and 832. In some instances, one or more shortening pins (not shown) may be disposed in the antenna 800 electrically connecting the ground plane 816 to one or more patches 840 to suppress unwanted mode excitations. The foregoing calculations and analysis utilize techniques, such as the cavity model, discussed, for example, by Lee and Hsieh, and will, therefore, not be discussed in further detail herein.

Preferably, four conventional SMA probes 870, similar to the probe 70 discussed above with respect to FIG. 1, are provided for feeding a linear polarized (LP) signal from a cable (not shown) to feed points in the antenna 800. The SMA probes 870 include, for delivering EM energy to and/or from the antenna 800, an outer conductor 872 which is electrically connected to the ground plane 816, and an inner (or feed) conductor 874 which is electrically connected to a respective strip 820. Each inner conductor 874 is preferably connected to a respective strip 820 substantially along a longitudinal center (FIG. 9), but circumferentially off of a center 804 (FIG. 10) of the strip 820 by a circumferential distance 806 of between about 0.125 $\lambda_\epsilon$ and 0.250 $\lambda_\epsilon$. While the SMA probe 870 is preferred, any suitable coaxial probe and/or connection arrangement may be used to implement the foregoing connections. For example, a conductive adhesive (not shown) may be used to bond and maintain contact between each inner conductor 874 and each respective strip 820, and an appropriate seal (not shown) may be provided where the SMA probe 870 passes through the ground plane 816 to hermetically seal the connection. Though not shown, it is understood that the end of the SMA probe 870, not connected to the antenna 800, is connectable via a cable (not shown) to a signal generator or to a receiver (not shown).

In operation, the antenna 800 may be used for receiving and/or transmitting EM radiation beams of which the electric field is polarized in the azimuthal direction. To exemplify how the antenna 800 may be used, the antenna 800, oriented as shown in FIG. 8, may be positioned in a telecommunications cell site for use as a base station antenna for transmitting to and receiving from mobile cellular phones (not shown) an EM beam carrying a communication signal within a predetermined frequency band or channel.

Assuming that the elements of the antenna 800 are correctly sized for transmitting and receiving such communication signals, then signals will pass through the apertures 850, and induce a standing wave, which will resonate between the two dielectric layers 812 and 814. To exemplify with respect to the transmission of communication signals, when a transmitter (not shown), such as an encoder, generates signals to the SMA probe 870, a standing wave is induced in the transmission-line cavity defined by the dielectric layer 812 and the signal is transmitted from the antenna 800 through the apertures to mobile phones within the cell (not shown).

It is well-known that antennas transmit and receive signals reciprocally. Accordingly, it can be appreciated that the operation of the antenna 800 for receiving signals is reciprocally identical to that of the antenna for receiving signals. To that end, with respect to the reception of communication signals, signals generated by a cell phone (not shown) to the antenna 800 pass through the apertures 850 and induce a standing wave in the transmission-line cavity defined by the dielectric layer 812, and the signal is communicated through the SMA probe 870 to a receiver, such as a decoder (not shown).

It is understood that the present invention as depicted by the embodiments of FIGS. 8–10 may take many forms and embodiments. Accordingly, several variations may be made in the foregoing without departing from the spirit or the scope of the invention. For example, if additional patches are positioned onto the dielectric 814 so that every slot 830 and 832 is covered, and so that all the patches 840 are electromagnetically coupled, then a single feed line 870 would be effective to feed electromagnetic energy to/from the antenna 800 for transmission and/or reception of signals in azimuthal omnidirectional directions.

Figure 12:
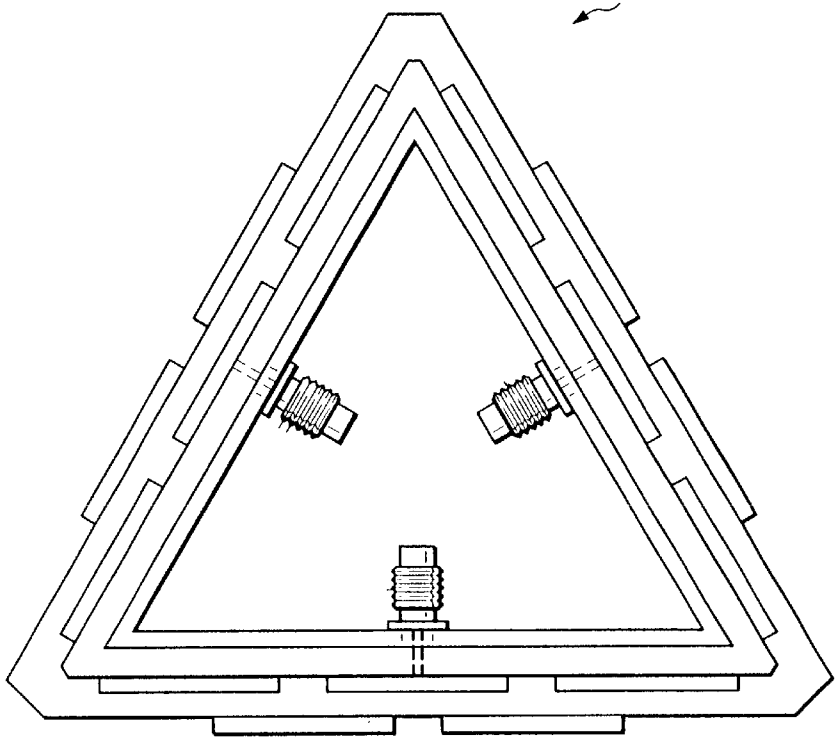
FIG. 12 is a plan view of the antenna of FIG. 11.
Figure 11:
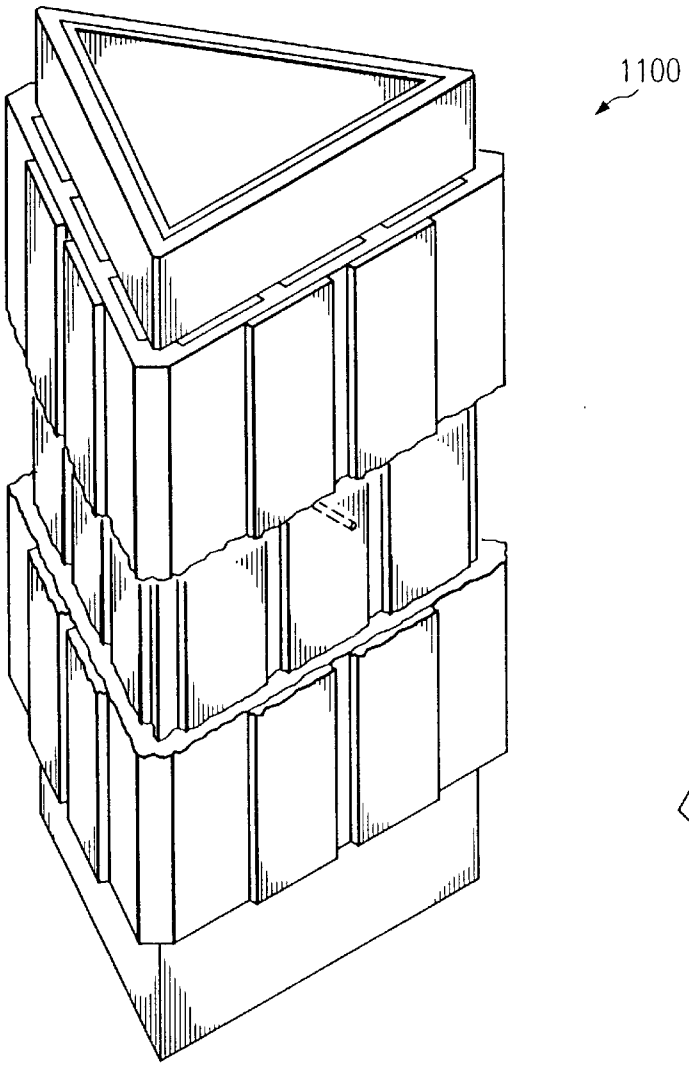
FIG. 11 is a partially cut-away perspective view of a triangular array antenna.

FIGS. 11–12 depict an array antenna 1100 having a triangular cross-section configured for generating azimuthally polarized EM radiation patterns similar to the patterns generated by the antenna 800 described above with respect to FIGS. 8–10. The antenna 1100 is, furthermore, configured similarly to the antenna 800, but for having a triangular cross-section for servicing three substantially 120° sectors of a cell, rather than a circular cross-section configured for servicing four substantially 90° sectors of a cell. The cross-section of the antenna 1100 is sized according to the directivity desired for the antenna, wherein higher directivity is obtained using a larger cross-sectional area.

It will be appreciated that the antenna 1100 may be configured with more or less than three sides, wherein each side is provided with flat strips and patches, which, other than being flat, are substantially similar to corresponding curved strips and patches shown for one side of the antenna 800 in FIG. 8. The strips and patches on each side may, furthermore, be connected to an SMA probe for transmitting EM beams delivered from the SMA probe, and/or for receiving signals to be received by the SMA probe. Each side of the antenna 1100 corresponds to one sector of a cell. For example, the antenna 1100 may be configured with a square cross-section (instead of a triangular cross-section) for servicing four sectors of cell, as with the antenna 800 described above, with strips and patches on each side connected to a respective SMA probe for transmitting and receiving sectored EM beams in any one or more of four 90° sectors.

It is considered that, upon a reading of the present description, a person having ordinary skill in the art could readily modify the antenna 300 or 600 to have any number of sides, each of which sides correspond to one of a desired number of sectors of a cell to be served. Because the structure and operation of the antenna 600 is similar to that of the antenna 300 discussed above, the antenna 1100 will, therefore, not be discussed in further detail herein.

It is understood that any of the aforementioned antennas configured for operation at one frequency may be reconfigured for operation at substantially any other desired frequency, without significantly altering characteristics, such as the radiation pattern and efficiency of the antenna at the one frequency, by generally scaling each dimension of the antenna in direct proportion to the ratio of the desired frequency to the one frequency, provided that the dielectric constant of the dielectric layers remains substantially the same at the desired frequency as at the one frequency.

Although illustrative embodiments of the invention have been shown and described, a wide range of modification, change, and substitution is contemplated in the foregoing disclosure and, in some instances, some features of the present invention may be employed without a corresponding use of the other features. Accordingly, it is appropriate that the appended claims be construed broadly and in a manner consistent with the scope of the invention, and with the understanding that the reference numerals provided parenthetically are provided by way of example for the convenience and efficiency of examination, and are not to be construed as limiting any claim in any way.

What is claimed is:

1. A cylindrical, double-layer microstrip antenna comprising:

a first cylindrical dielectric layer defining first and second sides;

a conductive ground plane disposed on the first side of the first dielectric layer;

an array of conducting strips disposed on the second side of the first dielectric layer, the array of strips being spaced apart to form a slot between each pair of adjacent strips;

a second cylindrical dielectric layer defining first and second sides, the first side of the second dielectric layer being secured to the second side of the first dielectric layer and to the array of strips;

an array of radiating patches disposed on the second side of the second dielectric layer, each patch being located over one of the slots, the array of patches being spaced apart to form an aperture between each pair of adjacent patches so that, responsive to electromagnetic energy, a high order standing wave is induced in the antenna; and at least one feeding means comprising a first conducting element electrically connected to the ground plane, and a second conducting element electrically connected to a strip connected for feeding electromagnetic energy to and/or extracting electromagnetic energy from the antenna.

2. The antenna of claim 1 wherein the feeding means is at least one of a probe, an SMA probe, an aperture-coupled line, and a microstripline connected to feed electromagnetic energy to and/or extract electromagnetic energy from the antenna.

3. The antenna of claim 1 wherein the strips, slots, patches, and apertures are sized so that, responsive to electromagnetic energy, a high-order standing wave is induced in the antenna.

4. The antenna of claim 1 wherein the first and second dielectric layers and the ground plane are cylindrically-shaped, and the strips and patches conform to the cylindrical surface and are longitudinally spaced.

5. The antenna of claim 1 wherein the first and second dielectric layers and the ground plane are cylindrically-shaped, and the strips and patches conform to the cylindrical surface and are longitudinally spaced, and wherein one feeding means is electrically connected to one strip within about one half wavelength from the longitudinal center of the antenna.

6. The antenna of claim 1 wherein the first and second dielectric layers and the ground plane are cylindrically-shaped with a substantially circular cross-section, and the strips and patches conform to the cylindrical surface and are apportioned into two or more sectored portions, wherein the sectored portions of each strip and patch are circumferentially spaced, and the strips and patches are longitudinally spaced, and wherein one feeding means is electrically connected to each sectored portion of one strip within about one half wavelength from the longitudinal center of the antenna and substantially centered circumferentially on each respective sectored portion for reception or transmission of longitudinally polarized radiation.

7. The antenna of claim 1 wherein first and second dielectric layers have a geometric cross-sectional shape of a parallelogram, and each of the strips and patches are substantially planar and rectangular.

8. The antenna of claim 1 wherein the first and second dielectric layers have a triangular cross-section defining three planar sides, the strips and patches are substantially planar and rectangular, and a plurality of strips and patches are positioned on each side and longitudinally spaced thereon for reception or transmission of longitudinally polarized radiation.

9. The antenna of claim 1 wherein the first and second dielectric layers are triangular-shaped to define three planar sides, the strips and patches are substantially planar and rectangular, and a plurality of strips and patches are positioned on each side and longitudinally spaced thereon for reception or transmission of longitudinally polarized radiation, and wherein one feeding means is electrically connected to one strip on each side along the circumferential center of each sector within about one half wavelength from the longitudinal center of the antenna.

10. The antenna of claim 1 wherein the first and second dielectric layers and the ground plane are cylindrically-shaped, and the strips and patches conform to the cylindrical surface and are longitudinally spaced, and the strips and patches are divided into two or more sectored portions and are circumferentially spaced on the first and second dielectrics.

11. The antenna of claim 1 wherein the first and second dielectric layers and the ground plane are cylindrically-shaped, and the strips and patches conform to the cylindrical surface and are longitudinally spaced, and the strips and patches are divided into two of more sectored portions and circumferentially spaced on the first and second dielectrics, and the strips and patches are circumferentially spaced, and wherein one feeding means is electrically connected to each sectored portion of one strip along the circumferential center within about one half wavelength from the longitudinal center of one strip for reception or transmission of longitudinally polarized radiation.

12. The antenna of claim 1 wherein the first and second dielectric layers are triangular-shaped to define three planar sides, the strips and patches are substantially planar and rectangular, and a plurality of strips and patches are positioned on each side and circumferentially spaced thereon.

13. The antenna of claim 1 wherein the first and second dielectric layers are triangular-shaped to define three planar sides, the strips and patches are substantially planar and rectangular, and a plurality of strips and patches are positioned on each side and circumferentially spaced thereon, and wherein one feeding means is electrically connected to each sectored portion of one strip along the circumferential center within about one half wavelength from the longitudinal center of at least one strip for reception or transmission of longitudinally polarized radiation.

14. A cylindrical, double-layer microstrip antenna comprising:

first and second cylindrical dielectric layers having first sides secured together with an array of conducting strips interposed therebetween, the strips being spaced to define a slot between each pair of adjacent strips;

a conductive ground plane disposed on an interior second side of the first dielectric layer;

an array of radiating patches disposed on an exterior second side of the second dielectric layer, each of which patches is positioned over a corresponding slot, the array of patches being spaced apart to form an aperture between each pair of adjacent patches so that, responsive to electromagnetic energy, a high-order standing wave is induced in the antenna and a directed beam is transmitted from or received into the antenna.

15. The antenna of claim 14 further comprising at least one feeding means connected to the ground plane and at least one strip for feeding electromagnetic energy to and/or extracting electromagnetic energy from the antenna.

16. The antenna of claim 14 further comprising at least one feeding means having a first conducting element electrically connected to the ground plane and a second conducting element electrically connected to at least one strip for feeding electromagnetic energy to and/or extracting electromagnetic energy from the antenna.

17. The antenna of claim 14 further comprising at least one of a probe, an SMA probe, an aperture-coupled line, and a microstripline connected to the ground plane and at least one strip for feeding electromagnetic energy to and/or extracting electromagnetic energy from the antenna.

18. The antenna of claim 14 further comprising at least two feeding means each of which comprise one of a probe, an SMA probe, an aperture-coupled line, and a microstripline, each of which feeding means are orthogonally connected to the ground plane and at least one strip for feeding electromagnetic energy to and/or extracting electromagnetic energy from the antenna.

19. The antenna of claim 14 wherein the strips, slots, patches, and apertures are sized so that, responsive to electromagnetic energy, a high-order standing wave is induced in the antenna.

20. The antenna of claim 14 wherein the first and second dielectric layers, the strips, and the patches are cylindrically-shaped, and the strips and patches are azimuthally spaced for the reception or transmission of azimuthally polarized radiation.

21. The antenna of claim 14 wherein the first and second dielectric layers are cylindrically-shaped, the strips and patches conform to the cylindrically-shaped dielectric layers, and the strips and patches are azimuthally spaced for the reception or transmission of azimuthally polarized radiation, and wherein the antenna further comprises feeding means for feeding electromagnetic energy to and/or extracting electromagnetic energy from the antenna, wherein one feeding means is electrically connected to one strip along the longitudinal center and within about one half wavelength from the circumferential center.

22. The antenna of claim 14 wherein the first and second dielectric layers and the ground plane are cylindrically-shaped, the strips and patches conform to the cylindrically-shaped first and second dielectric layers, and the first and second dielectric layers are apportioned into two or more sectored portions, wherein the sectored portions of each strip and patch are circumferentially spaced, and the strips and patches are circumferentially spaced, and wherein the antenna further comprises feeding means for feeding electromagnetic energy to and/or extracting electromagnetic energy from the antenna, wherein one feeding means is electrically connected to each sectored portion of one strip along the longitudinal center of the patch within about one half wavelength circumferentially from the circumferential center of the patch.

23. The antenna of claim 14 wherein first and second dielectric layers have a geometric cross-sectional shape of a parallelogram, and each of the strips and patches are planar and rectangular.

24. The antenna of claim 14 wherein the first and second dielectric layers are triangular-shaped to define three planar sides, the strips and patches are substantially planar and rectangular, and a plurality of strips and patches are positioned on each side and longitudinally spaced thereon.

25. The antenna of claim 14 wherein the cross-sectional area of the first and second dielectric layers is triangular-shaped to define three planar sides, the strips and patches are substantially planar and rectangular, and a plurality of strips and patches are positioned on each side and circumferentially spaced thereon, and wherein the antenna further comprises feeding means for feeding electromagnetic energy to and/or extracting electromagnetic energy from the antenna, wherein one feeding means is electrically connected to each sectored portion of one strip along the longitudinal center of the patch within about one half wavelength circumferentially from the circumferential center of the patch.

26. The antenna of claim 14 wherein the first and second dielectric layers and the ground plane, are cylindrically-shaped, and the strips and patches are divided into two or more sectored portions and conformed on the dielectric surfaces and circumferentially spaced on the first and second dielectrics.

27. The antenna of claim 14 wherein the first and second dielectric layers and the ground plane, are cylindrically-shaped, and the strips and patches are divided into two or more sectored portions and conformed on the dielectric surfaces and circumferentially spaced on the first and second dielectrics, and wherein the antenna further comprises feeding means for feeding electromagnetic energy to and/or extracting electromagnetic energy from the antenna, wherein one feeding means is electrically connected to each sectored portion of one strip along the longitudinal center of the patch within about one half wavelength circumferentially from the circumferential center of the patch.

28. The antenna of claim 14 wherein the first and second dielectric layers are triangular-shaped to define three planar sides, the strips and patches are substantially planar and rectangular, and a plurality of strips and patches are positioned on each side and circumferentially spaced thereon.

29. The antenna of claim 14 wherein the first and second dielectric layers are triangular-shaped to define three planar sides, the strips and patches are substantially planar and rectangular, and a plurality of strips and patches are positioned on each side and circumferentially spaced thereon, and wherein the antenna further comprises feeding means for feeding electromagnetic energy to and/or extracting electromagnetic energy from the antenna, wherein one feeding means is electrically connected to each sectored portion of one strip along the longitudinal center of the patch within about one half wavelength circumferentially from the circumferential center of the patch.

* * * * *